US009014613B2

(12) United States Patent
Okano

(10) Patent No.: US 9,014,613 B2
(45) Date of Patent: Apr. 21, 2015

(54) EASILY ACCESSIBLE EJECTION TRAY FOR IMAGE FORMING APPARATUS

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/413,711

(22) Filed: Mar. 7, 2012

(65) Prior Publication Data

US 2012/0230748 A1 Sep. 13, 2012

(30) Foreign Application Priority Data

Mar. 8, 2011 (JP) ..... 2011-050312

(51) Int. Cl.

| | |
|---|---|
| ***G03G 15/00*** | (2006.01) |
| ***B65H 31/02*** | (2006.01) |
| ***B41J 13/10*** | (2006.01) |
| *B65H 31/00* | (2006.01) |
| *B65H 31/30* | (2006.01) |
| *B65H 31/20* | (2006.01) |

(52) U.S. Cl.

CPC ..... *B41J 13/106* (2013.01); *B65H 31/00* (2013.01); *B65H 31/30* (2013.01); *B65H 31/02* (2013.01); *B65H 31/20* (2013.01); *B65H 31/3036* (2013.01)

(58) Field of Classification Search

CPC .... B65H 31/02; B65H 31/30; B65H 31/3036; B65H 31/20

USPC ..... 399/405; 271/207

See application file for complete search history.

(56) References Cited

U.S. PATENT DOCUMENTS

| | | | | |
|---|---|---|---|---|
| 6,755,733 | B2 * | 6/2004 | Horiguchi et al. | 454/184 |
| 6,923,438 | B2 * | 8/2005 | Matsuyama et al. | 271/207 |
| 7,484,729 | B2 * | 2/2009 | Ono et al. | 271/209 |
| 2005/0047841 | A1 * | 3/2005 | Kubo | 399/405 |
| 2008/0067737 | A1 * | 3/2008 | Kosuda et al. | 271/207 |

FOREIGN PATENT DOCUMENTS

| | | | |
|---|---|---|---|
| JP | 54-133580 | | 9/1979 |
| JP | 11-157732 | | 6/1999 |
| JP | 2001063897 | A * | 3/2001 |
| JP | 2001-130089 | | 5/2001 |
| JP | 2007-302387 | | 11/2007 |

* cited by examiner

*Primary Examiner* — Daniel J Colilla
*Assistant Examiner* — John M Royston
(74) *Attorney, Agent, or Firm* — Banner & Witcoff, Ltd.

(57) ABSTRACT

An image forming apparatus includes an image forming unit, an ejection portion from which a first sheet and a second sheet having images formed in the image forming unit are to be ejected, an ejection tray including a receiving portion configured to receive the sheet ejected from the ejection portion, and a stopper portion disposed on a downstream side of the ejection tray in a sheet ejection direction further than the ejection portion. The receiving portion has first and second recessed portions, which are recessed downward therefrom. The stopper portion is configured to stop the sheet ejected from the ejection portion. The recessed portions are located downstream from the ejection portion and upstream from the stopper portion in the sheet ejection direction, and spaced apart from each other at least in the sheet ejection direction.

17 Claims, 9 Drawing Sheets

EASILY ACCESSIBLE EJECTION TRAY FOR IMAGE FORMING APPARATUS

CROSS REFERENCE TO RELATED APPLICATION

This application claims priority from Japanese Patent Application No. 2011-050312, filed on Mar. 8, 2011, the entire subject matter of which is incorporated herein by reference.

FIELD

Aspects of the disclosure relate to an image forming apparatus.

BACKGROUND

A known image forming apparatus may include an ejection tray. The ejection tray includes a grooved, recessed portion extending from one end to the other end in a width direction to facilitate picking up of an ejected sheet from the ejection tray, thereby improving the usability of the image forming apparatus.

The ejection tray is a place where a sheet on which an image has been formed is ejected. The width direction is perpendicular to a sheet ejection direction where the sheet having the image is ejected, and corresponds to a front-rear direction of the image forming apparatus. Thus, in the image forming apparatus, one end in the width direction is referred to as a front side, and the other end is referred to as a rear side, and the recessed portion extends from the front end toward the rear side.

However, the recessed portion does not extend in the sheet ejection direction. Thus, it is difficult to pick up various-sized sheets ejected to the ejection tray from the sheet ejection direction.

SUMMARY

Illustrative aspects of the disclosure provide an image forming apparatus configured to facilitate picking up of various-sized sheets ejected to an ejection tray from a sheet ejection direction.

BRIEF DESCRIPTION OF THE DRAWINGS

Illustrative aspects will be described in detail with reference to the following figures in which like elements are labeled with like numbers and in which.

DETAILED DESCRIPTION

Figure 1:
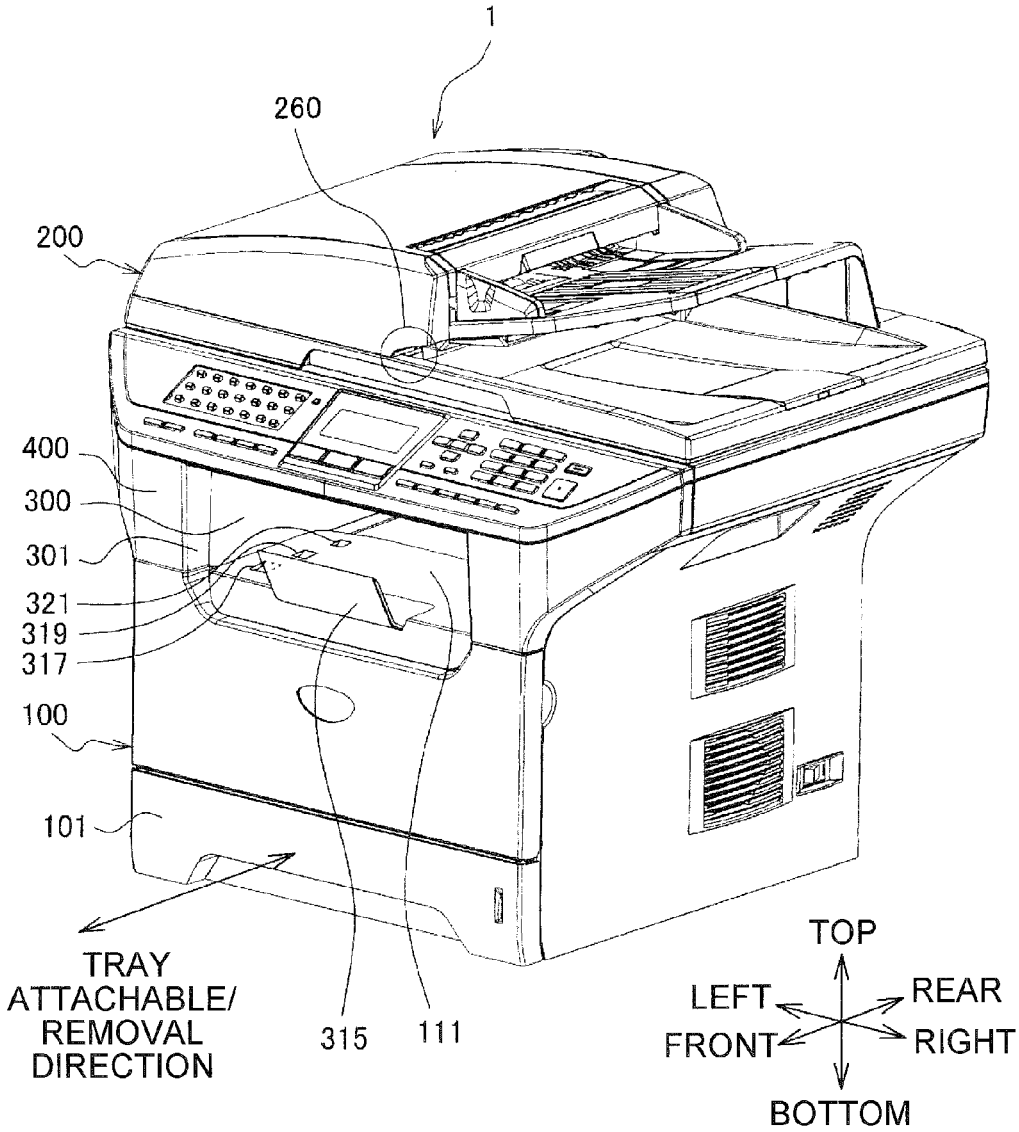
FIG. 1 is a perspective view of an outer appearance of an illustrative example of an image forming apparatus according to a first embodiment of the disclosure.

A first embodiment will be described in detail with reference to the accompanying drawings. As shown in FIG. 1, aspects of the disclosure are applied to an image forming apparatus 1 combining an image forming unit 100 and an image reading unit 200 together.

A general structure of the image forming apparatus 1 will be described with reference to FIG. 1.

The image forming unit 100 is configured to form an image on a recording medium, e.g., a sheet of plain paper, a transparency, etc., (hereinafter referred to as a sheet). The image reading unit 200 is configured to read an image of a document and output the read image as electronic data. The image reading unit 200 is disposed above the image forming unit 100 such that an ejected sheet accommodating space 300 is provided between the image reading unit 200 and the image forming unit 100.

The ejected sheet accommodating space 300 is a space where a sheet on which an image is formed at the image forming unit 100 is to be ejected and accommodated. The ejected sheet accommodating space 300 is surrounded on three sides by the image forming unit 100, the image reading unit 200, and a joint member 400 coupling the image forming unit 100 and the image reading unit 200.

The ejected sheet accommodating space 300 is provided between the image forming unit 100 and the image reading unit 200 and is open at one side only (e.g., a front side in this embodiment). In other words, the ejected sheet accommodating space 300 is surrounded by the image forming unit 100, the image reading unit 200, and the joint member 400 except on the front side. Thus, a user reaches into the ejected sheet accommodating space 300 from the front side, which is the only open side (hereinafter referred to as a sheet pickup opening 301) to pick up a sheet on which an image has been formed at the image forming unit 100.

Figure 2:
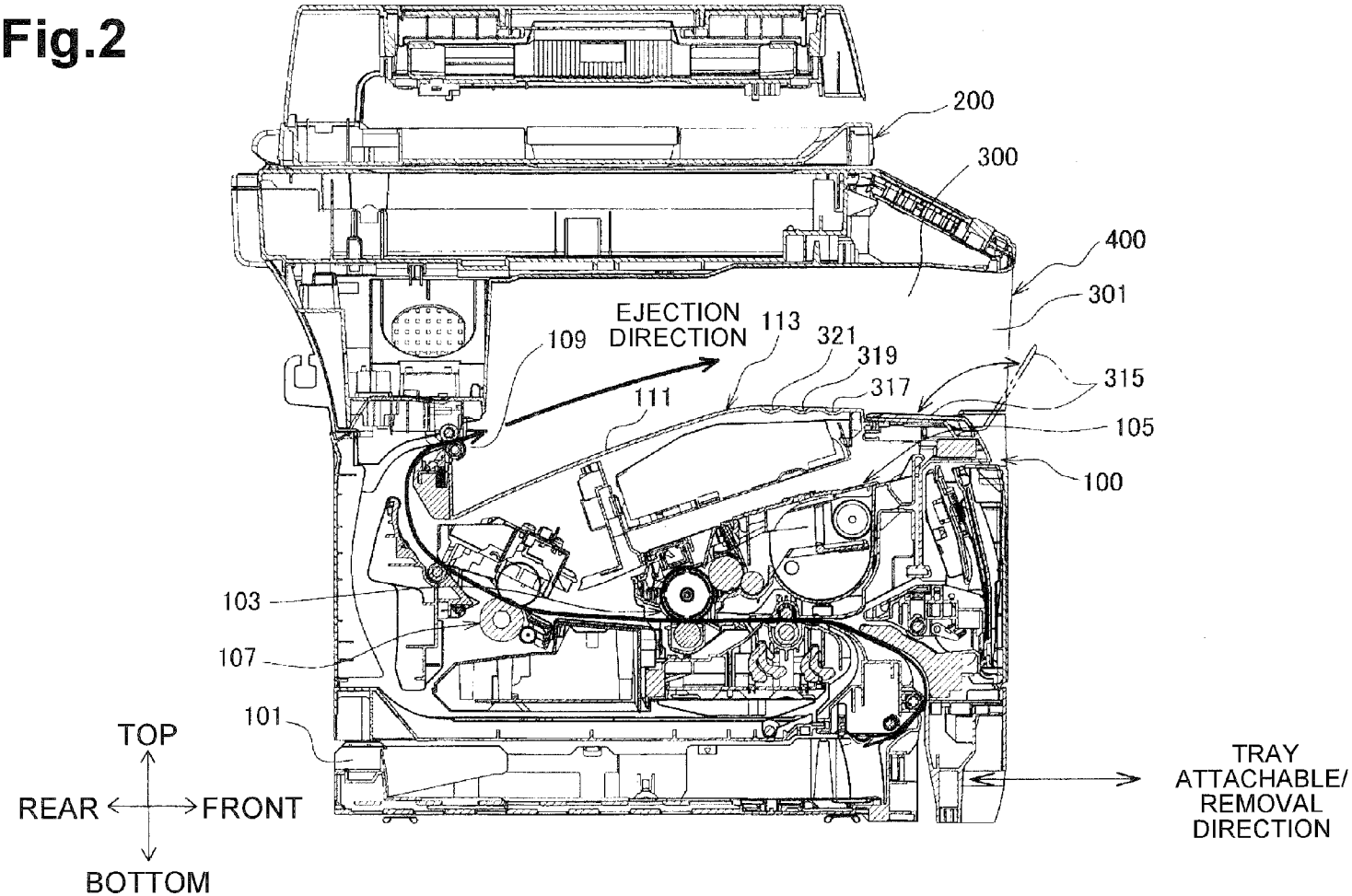
FIG. 2 is a sectional view of the image forming apparatus.

The image forming unit 100 is of an electrophotographic type. Specifically, as shown in FIG. 2, a sheet supply tray 101 is disposed in the lowermost part of the image forming unit 100. The sheet supply tray 101 is configured to have a stack of sheets loaded therein and supply the sheets toward a process cartridge 105 disposed above the sheet supply tray 101. The process cartridge 105 includes a photosensitive drum 103.

As a developer image carried on the photosensitive drum 103 is transferred onto the sheet, the sheet is heated at a fixing unit 107, the transferred developer image is fixed to the sheet, and thus image formation to the sheet is completed.

The sheet on which image formation is completed is ejected from an ejection portion 109 toward the sheet pickup opening 301 of the ejected sheet accommodating space 300, and received on a receiving portion 111 provided on an upper surface of the image forming unit 100 (or a bottom surface defining the ejected sheet accommodating space 300).

On the upper surface of the image forming unit 100 (the bottom surface defining the ejected sheet accommodating space 300), a portion including the receiving portion 111 and covering from the ejection portion 109 to the sheet pickup opening 301 (a front-side opening of the ejected sheet accommodating space 300) is referred to as an ejection tray 113.

The ejection tray 113 includes a stopper portion 315 on a downstream side in a sheet ejection direction where a sheet is ejected from the ejection portion 109 (on a side close to the sheet pickup opening 301 in this embodiment). The stopper portion 315 is configured to stop sheets ejected from the ejection portion 109. The stopper portion 315 has the form of a plate, and is pivotally assembled on the side close to the sheet pickup opening 301.

The stopper portion 315 is pivoted to an open position (as shown by chain double-dashed line in FIG. 2) such that its plate surface crosses the sheet ejection direction when there is a need to stop sheets, and is pivoted to a closed position (as shown by a solid line in FIG. 2) such that its plate surface is parallel to the sheet ejection direction when there is no need to stop sheets.

Figure 3A:
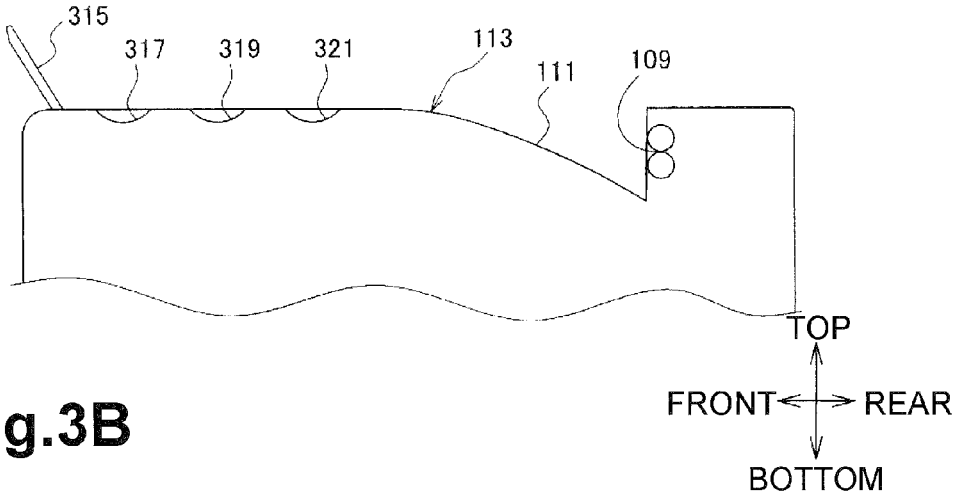
FIG. 3A is a sectional view of an ejection tray.
Figure 3B:
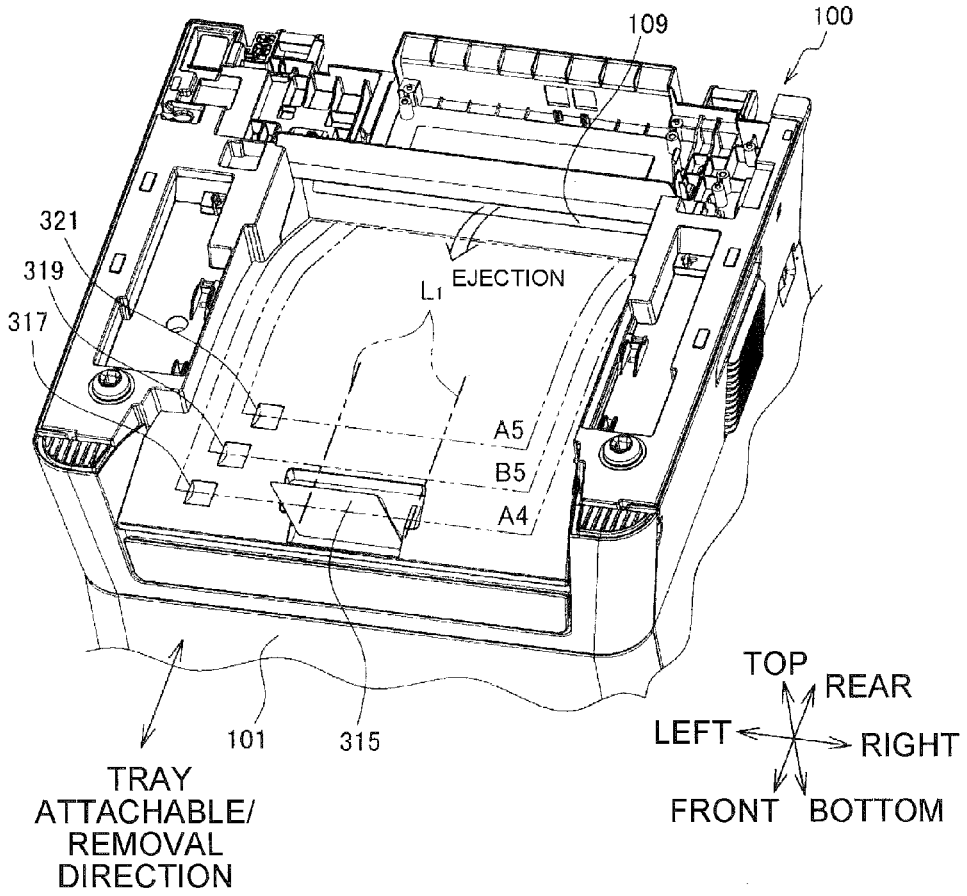
FIG. 3B is a perspective view of an image forming unit of the image forming apparatus from which an image reading unit is removed, as viewed from above.

As shown in FIG. 3A, the ejection tray 113 includes recessed portions 317, 319, 321, which are recessed downward from a surface on which ejected sheets are placed, and located downstream from the ejection portion 109 and upstream from the stopper portion 315. As shown in FIG. 3B, the recessed portions 317, 319, 321 are spaced apart from each other in the sheet ejection direction and a width direction.

As described above, the sheet ejection direction is referred to as a direction where a sheet is ejected from the ejection portion 109, and the width direction is referred to as a direction perpendicular to the sheet ejection direction among directions parallel to the ejection tray 113. In this embodiment, the sheet ejection direction corresponds to a front-rear direction of the image forming apparatus 100, and the width direction corresponds to a left-right direction of the image forming apparatus 100.

The recessed portions 317, 319, 321 are located in positions shifted toward an end in the width direction from an area extending from the stopper portion 315 to the ejection portion 109 along the sheet ejection direction. In addition, the positions of the recessed portions 317, 319, 321 correspond to end portions of sheets of each size to be ejected from the ejection portion 109.

"The area extending to the ejection portion along the sheet ejection direction" is referred to as an area defined by two phantom lines L1 extending from ends of the stopper portion 315 in the width direction toward the ejection portion 109. Hereinafter, the area defined by the two phantom lines L1 is referred to as a stopper projection area.

In FIG. 3B, chain double-dashed lines shown on the receiving portion 111 of the ejection tray 113 indicate outlines of sheets, which carry images that can be formed by the image forming unit 100, to be ejected to ejected sheet accommodating space 300 and received onto the receiving portion 111 of the ejection tray 113.

As apparent from relationship between each of the chain double-dashed lines and each of the recessed portions 317, 319, 321, each of the recessed portions 317, 319, 321 is located in such a position that it is on a leading end line (front end line) of a sheet ejected from the ejection portion 109 and shifted from an end portion (an left end portion in FIG. 3B) of the sheet ejected from the ejection portion 109 in the width direction toward a center (right side). In short, each of the recessed portions 317, 319, 321 is set in such a position that it is shifted toward a center in the width direction from a leading end-side corner of a sheet to be placed in the receiving portion 111 in the sheet feed direction.

The recessed portions 317, 319, 321 are set in positions closer to one end portion (left end in FIG. 3B) in the width direction as they are closer to the stopper portion 315 in a direction parallel to the sheet ejection direction. The stopper portion 315 is located in the other end portion (right side in FIG. 3B) in the width direction relative to the recessed portions 317, 319, 321.

In other words, the stopper portion 315 is located in a center in the width direction on the front side of the ejection tray 113, and the recessed portions 317, 319, 321 are located closer to the left side in the width direction as they are closer to the front side.

The recessed portion 317 is located in a position such that a lending end line of an A4-sized sheet is crossing over the recessed portion 317, the recessed portion 319 is located in a position such that a leading end line of a B5-size sheet is crossing over the recessed portion 319, and the recessed portion 321 is located in a position such that a leading end line of an A5-sized sheet is crossing over the recessed portion 321. The image reading unit 200 overlaps all recessed portions 317, 319, 321 in a plan view (refer to FIG. 2).

As shown in FIG. 3A, each of the recessed portions 317, 319, 321 is recessed downward smoothly to have substantially U-like cross section taken in a direction perpendicular to the width direction or the direction parallel to the sheet ejection direction. As shown in FIG. 3B, each of the recessed portions 317, 319, 321 has a square opening as viewed from above. In this embodiment, the opening is shaped in 30 mm×30 mm square and has a maximum depth of 5 mm.

The sheet supply tray 101 is non-destructively detachable from and attachable to the image forming unit 100 from the front side or the downstream side in the sheet ejection direction (on which the stopper portion 315 is disposed). When recording sheets are loaded in the sheet supply tray 101, the sheet supply tray 101 is pulled out from the front side of the main body of the image forming apparatus 1.

In this embodiment, the recessed portions 317, 319, 321 are disposed in the ejection tray 113 such that they are spaced apart from each other in the sheet ejection direction and the width direction perpendicular to the sheet ejection direction. The recessed portions 317, 319, 321 are located in the positions corresponding to the end portions of sheets to be ejected from the ejection portion 109 and being shifted from the stopper projection area.

With these recessed portions, the user can easily pick up various-sized sheets on the ejection tray 113 from the sheet ejection direction (from the side on which the stopper portion 315 is disposed) without interference between the hand and the stopper portion 315.

In this embodiment, a leading end of a sheet to be ejected onto the ejection tray 113 in the sheet ejection direction is placed toward the stopper portion 315.

At this time, the recessed portions 317, 319, 321 are disposed in the positions corresponding to the leading ends of sheets to be ejected form the ejection portion 109 in the sheet ejection direction, and thus the user can pick up the leading end of the sheet. Thus, various-sized sheets to be ejected onto the ejection tray 113 can be easily picked up from the sheet ejection direction.

Figure 4:
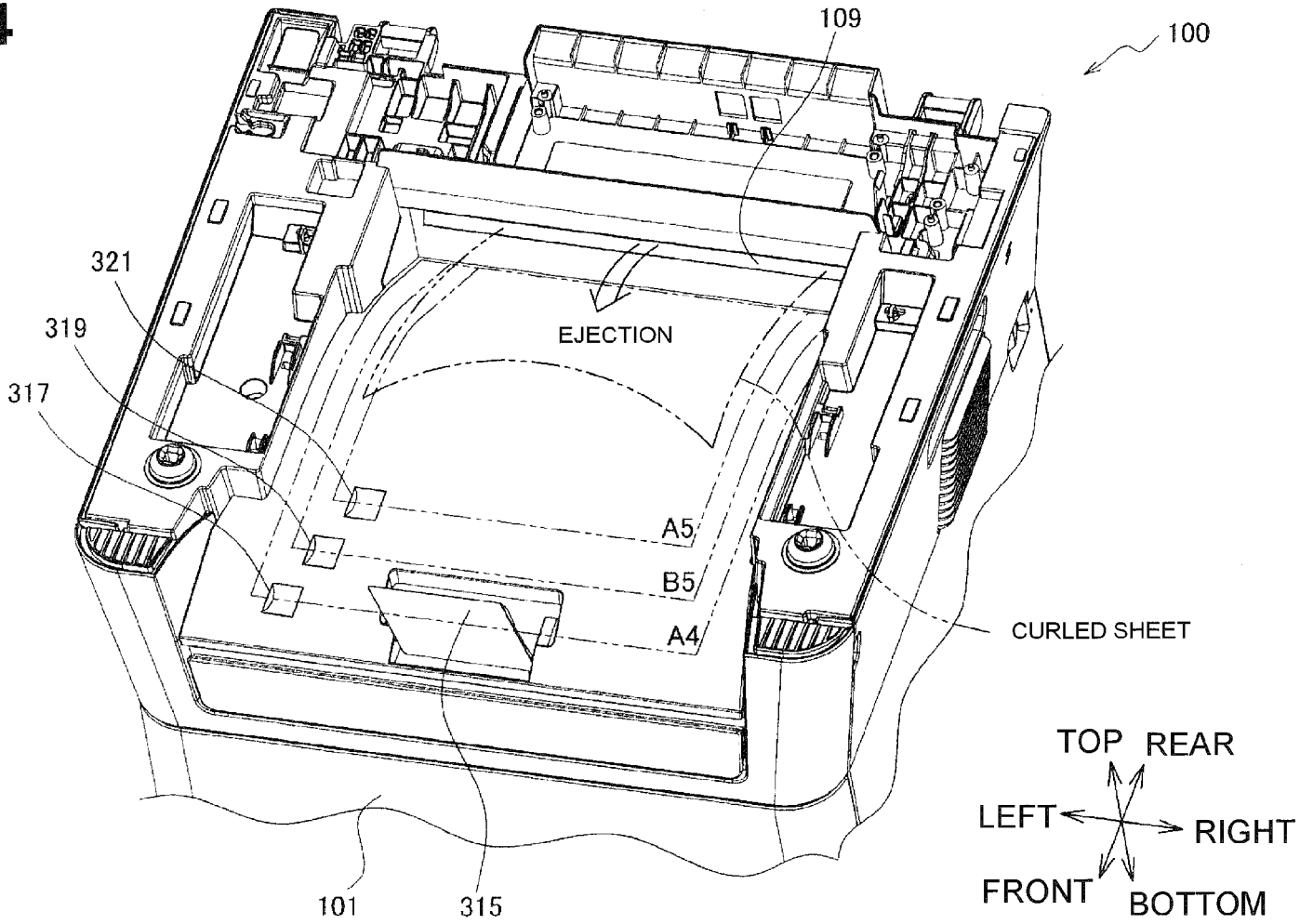
FIG. 4 shows that a curled sheet is being ejected.

In a case where a sheet ejected from the ejection portion 109 is curled (as shown by a chain double-dashed line in FIG. 4), if the recessed portions 317, 319, 321 are disposed in positions corresponding to ends of ejected sheets in the width direction, an end of the ejected curled sheet in the width direction may get caught in any of the recessed portions 317, 319, 321, and sheet ejection may be interrupted. The sheet is curled such that its axial direction corresponds to the sheet ejection direction.

On the contrary, in this embodiment, the recessed portions 317, 319, 321 are located in the positions shifted from ends of sheets to be ejected from the ejection portion 109 in the width direction toward a center. Thus, as the ends of ejected sheets do not get caught in any of the recessed portions 317, 319, 321, there is little likelihood that sheet ejection is interrupted.

In this embodiment, the recessed portions 317, 319, 321 are disposed closer to one end in the width direction as they are closer to the stopper portion 315 in the direction parallel to the sheet ejection direction. In addition, the stopper portion 315 is located on the other end in the width direction relative to the recessed portions 317, 319, 321, or on an opposite side to the recessed portions 317, 319, 321 in the width direction.

With this arrangement, the recessed portions 317, 319, 321 are located closer to the stopper portion 315 in the sheet ejection direction and are located farther away from the stopper portion 315 in the width direction. When the user reaches into the ejection tray 113 from the sheet ejection direction (from the side on which the stopper portion 315 is disposed), interference between the hand and the stopper portion 315 can be prevented. With these recessed portions 317, 319, 321, the user can pick up various-sized sheets from the ejection tray 113.

In this embodiment, the recessed portions 317, 319, 321 are recessed downward smoothly to have a U-like cross section taken in the direction perpendicular to the width direction. Thus, the user can easily pick up an ejected sheet by sliding finger along an inner surface of the recessed portion 317, 319, 321.

The ejected sheet accommodating space 300, which is formed between the ejection tray 113 and the image reading unit 200, is open only toward the stopper portion 315, and the image reading unit 200 overlaps all recessed portions 317, 319, 321 in a plan view.

Thus, in the image forming apparatus 1 according to the embodiment, to pick up a sheet ejected onto the ejection tray 113 from the ejected sheet accommodating space 300, the user has to reach into the ejection tray 113 from the sheet pickup opening 301, which is open on the downstream side (toward the stopper portion 315) in a sheet ejection direction as described above.

In this embodiment, as described above, the user can easily pick up various-sized sheets without interference against the stopper portion 315. It may be effective especially when the embodiment is applied to an image forming apparatus having the ejected sheet accommodating space 300, which is open only toward the stopper portion 315.

A second embodiment will be described.

Figure 5:
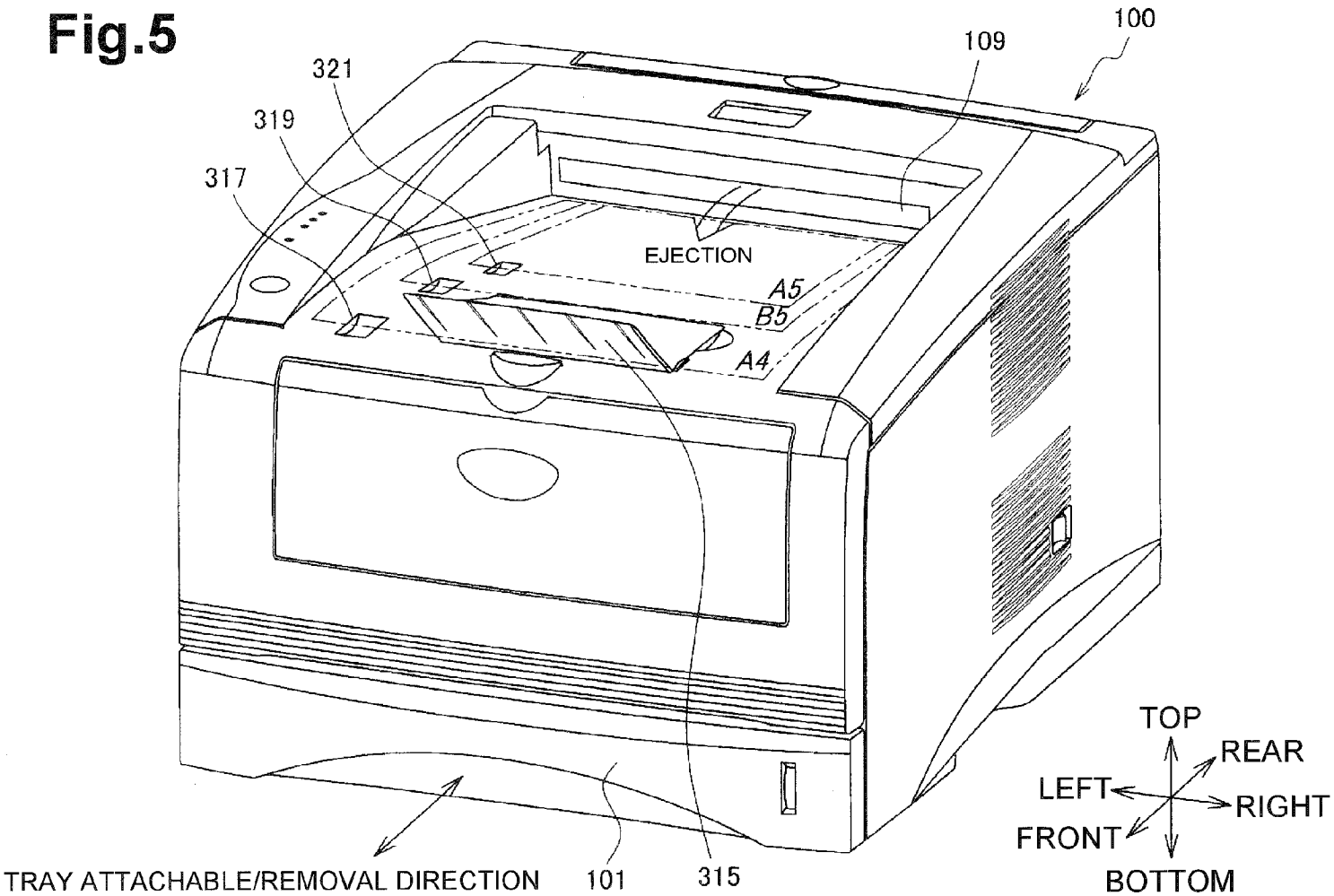
FIG. 5 is a perspective view of an outer appearance of an illustrative example of an image forming apparatus according to a second embodiment of the disclosure.

As shown in FIG. 5, the second embodiment is applied to an image forming apparatus including the image forming unit 100. The image forming apparatus of the second embodiment does not include the image reading unit 200 above the ejection tray 113.

In the second embodiment, the main body (or the image forming unit 100) is placed with the side having the stopper portion 315 facing the front side because maintenance such as loading of sheets needs to be performed by pulling out the sheet supply tray 101 from the front side (toward the stopper portion) of the main body (the image forming unit 100).

However, if there are obstructions, such as shelf boards, above and on the left and right sides of the image forming apparatus 1, the ejection tray 113 may be substantially surrounded on three sides. To pick up a sheet ejected on the ejection tray 113, the user inserts his/her hands into the ejection tray 113 from the downstream side (on which the stopper portion 315 is disposed) in the sheet ejection direction.

The image forming apparatus 1 according to the second embodiment also facilitates picking up of various-sized sheets ejected onto the ejection tray 113 from the sheet ejection direction (from the front side only) as in the case of the first embodiment. The sheets may be easily picked up even in the case where the image forming apparatus 1 is surrounded on three sides.

A third embodiment of the disclosure will be described with reference to FIGS. 6 and 7.

Figure 6:
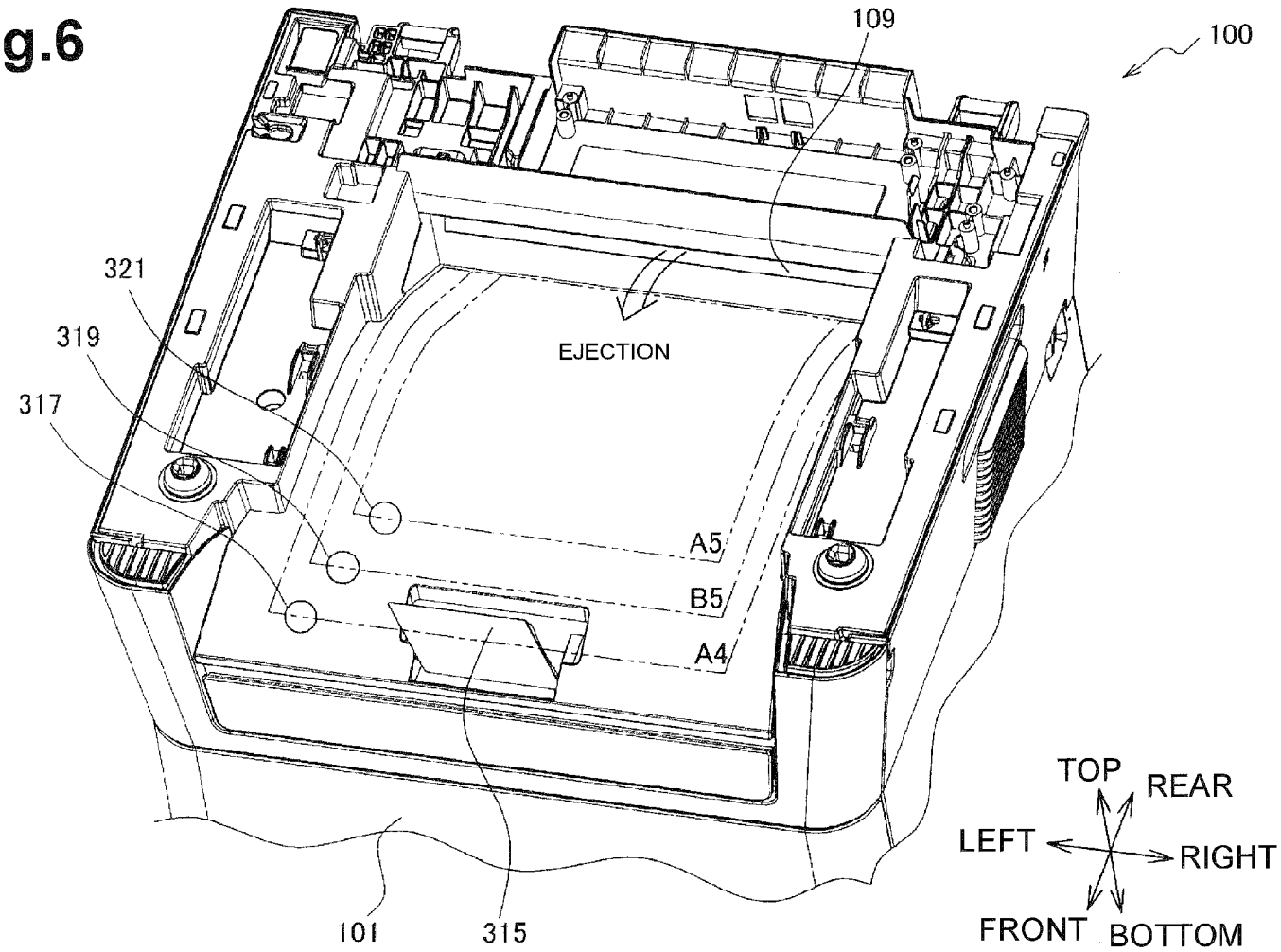
FIG. 6 is a perspective view of an image forming unit of the image forming apparatus from which an image reading unit is removed, as viewed from above, according to a third embodiment of the disclosure.
Figure 7:
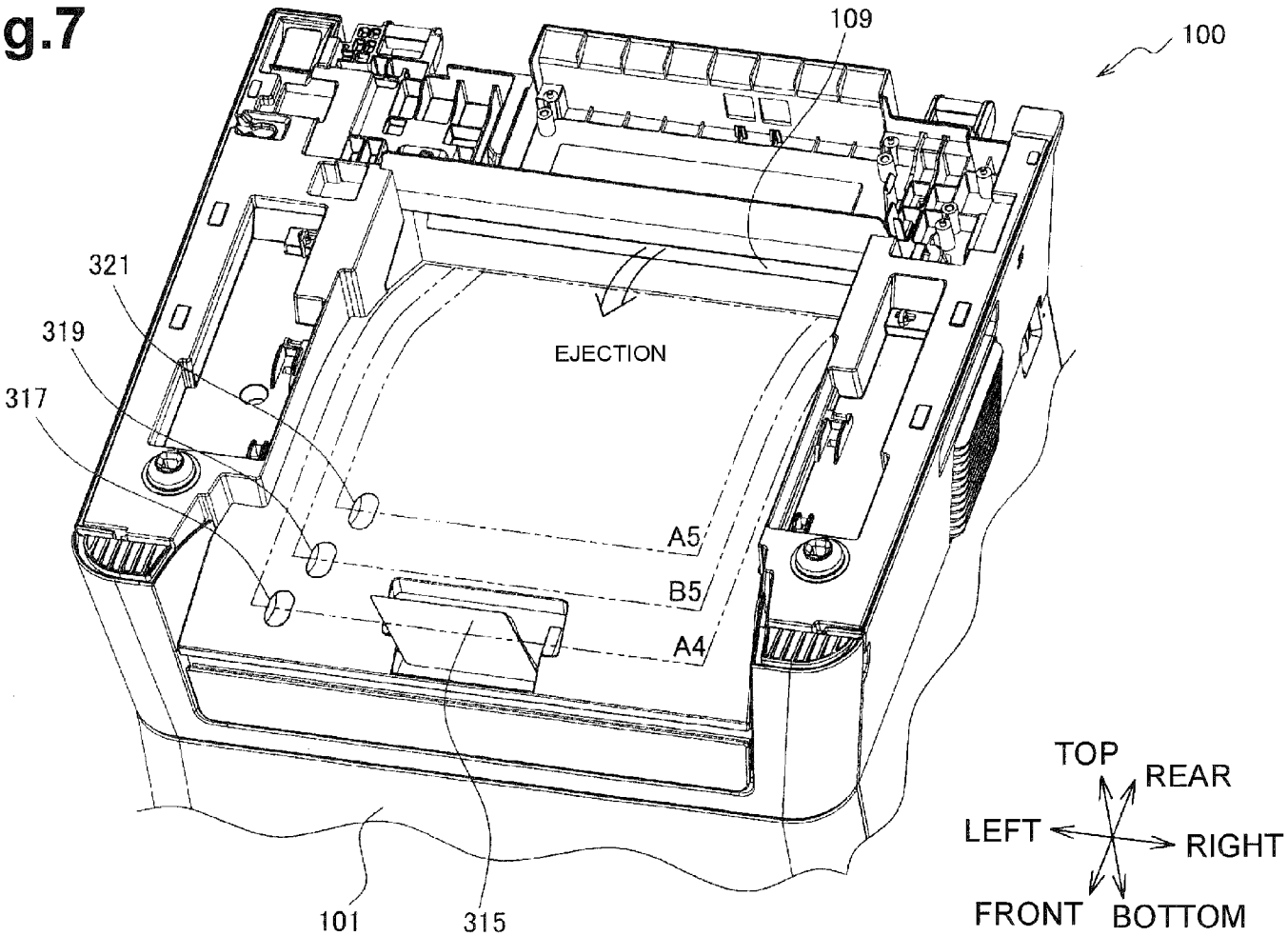
FIG. 7 is a perspective view of an image forming unit of the image forming apparatus from which an image reading unit is removed, as viewed from above, according to a third embodiment of the disclosure.

Although the above embodiments show the recessed portions 317, 319, 321 shaped like a square as viewed from above, the third embodiment shows the recessed portions 317, 319, 321 which are shaped except for the square as shown in FIGS. 6 and 7. FIG. 6 illustrates the recessed portions 317, 319, 321 each having a circular opening. FIG. 7 illustrates the recessed portions 317, 319, 321 each having an oval opening.

Figure 8:
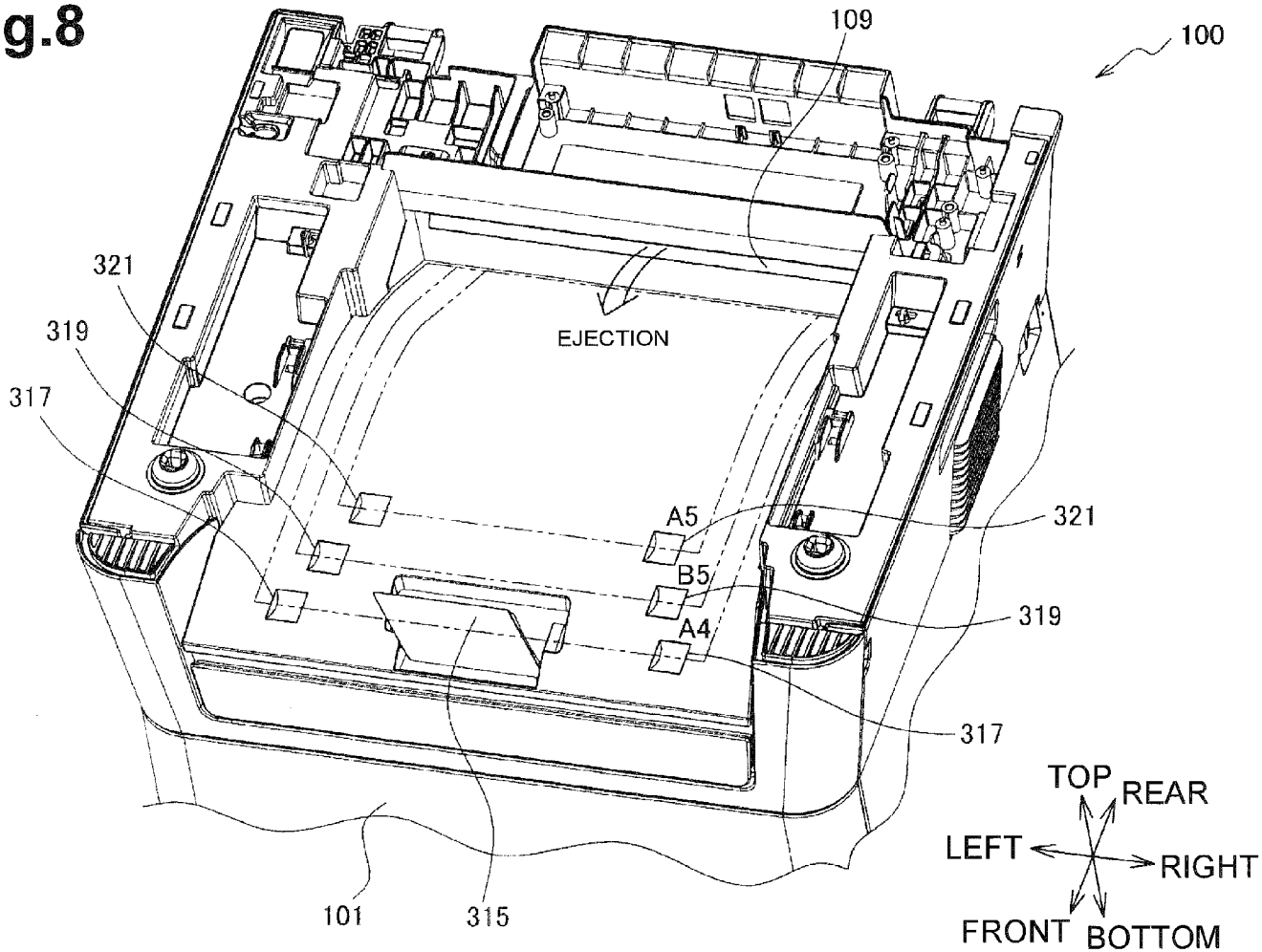
FIG. 8 is a perspective view of an image forming unit of the image forming apparatus from which an image reading unit is removed, as viewed from above, according to a fourth embodiment of the disclosure.

A fourth embodiment of the disclosure will be descried with reference to FIG. 8.

Although the above embodiments show the recessed portions 317, 319, 321 disposed on only one outer side of the stopper projection area in the width direction, the fourth embodiment shows the recessed portions 317, 319, 321 disposed on each outer side of the stopper projection area in the width direction.

FIG. 8 shows the fourth embodiment to which the recessed portions 317, 319, 321 according to the first embodiment are applied. The recessed portions 317, 319, 321 according to the third embodiment may be applicable to the fourth embodiment.

A fifth embodiment of the disclosure will be described with reference to FIG. 9.

Although the above embodiments show the recessed portions 317, 319, 321, which are recessed downward below the receiving portion that contacts a sheet to be ejected, the fifth embodiment shows protrusions, e.g., wall portions 317A, 319A, 321A, which protrude upward from the receiving portion and have an arc shape ascending from an upstream side toward a central portion along the sheet ejection direction. The wall portions 317A, 319A, 321A are disposed at ends of the respective recessed portions 317, 319, 321 in the width direction.

With this configuration, an ejected sheet is guided and raised by the wall portions 317A, 319A, and 321A. Thus, various-sized ejected sheets can be easily picked up from the front side.

Figure 9:
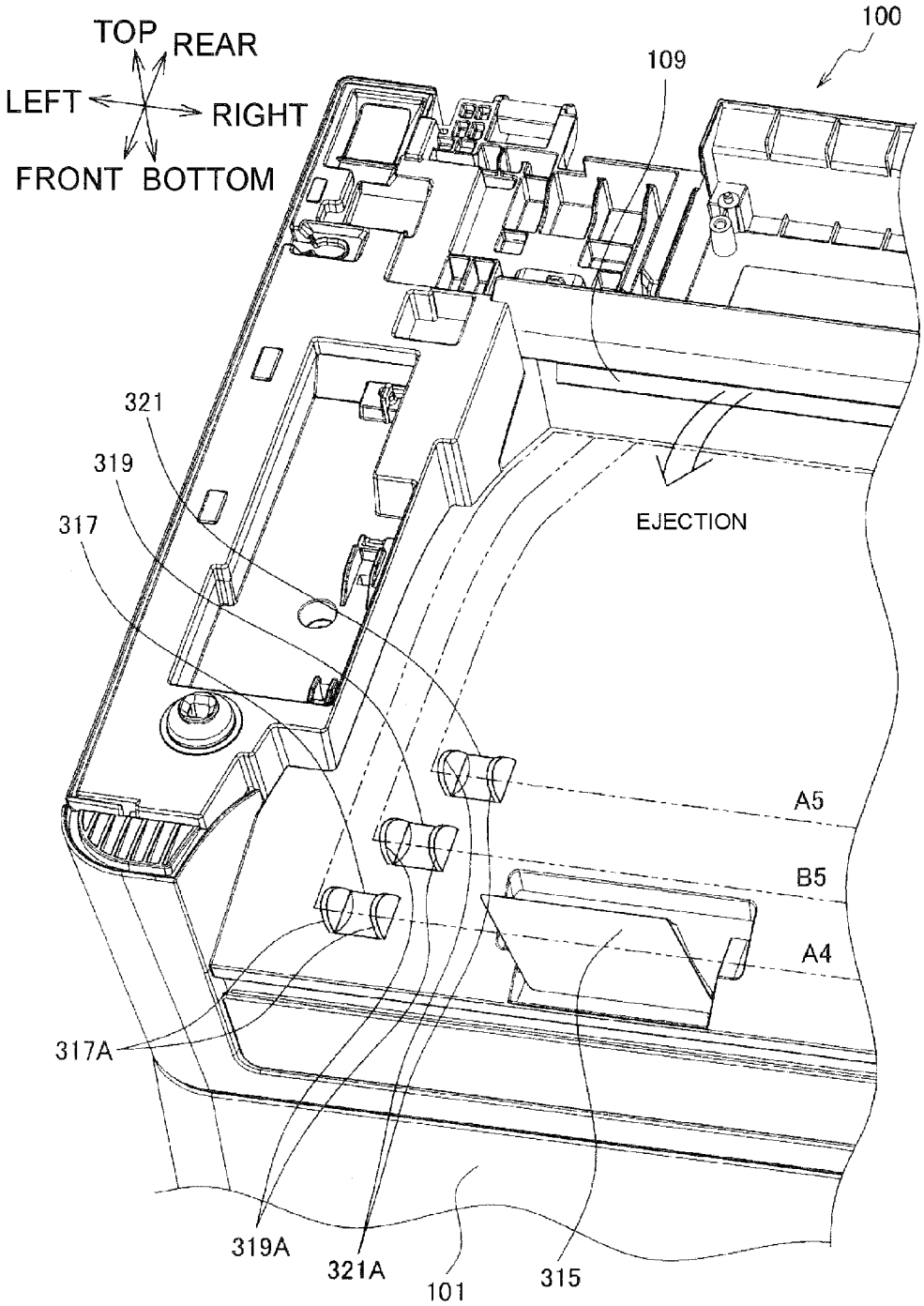
FIG. 9 is a is a perspective view of an image forming unit of the image forming apparatus from which an image reading unit is removed, as viewed from above, according to a fifth embodiment of the disclosure.

FIG. 9 illustrates that the wall portions 317A, 319A, 321A are disposed on both ends of each of the recessed portions 317, 319, 321 in the width direction. The wall portions 317A, 319A, 321A may be disposed on one side only of each of the recessed portions 317, 319, 321 in the width direction.

The above embodiments show, but are not limited to, the recessed portions 317, 319, 321 having substantially a U-like shape.

The above embodiments show, but are not limited to, the recessed portions 317, 319, 321 located in positions corresponding to leading ends of sheets to be ejected.

The above embodiments show, but are not limited to, that the stopper portion 315 is located in the center in the width direction on the front side of the ejection tray 113, and the recessed portions 317, 319, 321 are located closer to the left side in the width direction as they are closer to the front side.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit configured to form an image on a first sheet and a second sheet, the first sheet having a first size, the second sheet having a second size different from the first size;

an ejection portion from which the first sheet and the second sheet having the image formed in the image forming unit are to be ejected;

an ejection tray including a receiving portion configured to receive on a receiving surface the first sheet and the second sheet ejected from the ejection portion, the receiving portion having a first recessed portion and a second recessed portion, which are recessed downward therefrom; and a stopper portion disposed on a downstream side of the ejection tray in a sheet ejection direction further than the ejection portion, the stopper portion being configured to stop the first sheet and the second sheet ejected from the ejection portion, and the stopper portion defining a stopper projection area extending from the stopper portion to the ejection portion along the sheet ejection direction, wherein the first recessed portion and the second recessed portion are located downstream from the ejection portion and upstream from the stopper portion in the sheet ejection direction, wherein the first recessed portion and the second recessed portion are spaced apart from each other at least in the sheet ejection direction by at least a portion of the receiving surface, wherein the first recessed portion is located in a first position such that a downstream end, in the sheet ejection direction, of the first sheet completely ejected and received on the receiving surface of the ejection tray only partially covers the first recessed portion and the first recessed portion is shifted from the stopper projection area, wherein the second recessed portion is located in a second position such that a downstream end, in the sheet ejection direction, of the second sheet completely ejected and received on the receiving surface of the ejection tray only partially covers the second recessed portion and the second recessed portion is shifted from the first recessed portion at least in the sheet ejection direction, wherein the first recessed portion includes a first end and a second end spaced from each other in a width direction perpendicular to the sheet ejection direction and includes a first protrusion and a second protrusion such that the first protrusion of the first recessed portion is disposed at the first end of the first recessed portion and the second protrusion of the first recessed portion is disposed at the second end of the first recessed portion. and wherein the second recessed portion includes a first end and a second end spaced from each other in the width direction and includes a first protrusion and a second protrusion such that the first protrusion of the second recessed portion is disposed at the first end of the second recessed portion and the second protrusion of the second recessed portion is disposed at the second end of the second recessed portion.

2. The image forming apparatus according to claim 1, wherein the receiving portion is configured to support downstream end-side corners of the first sheet and the second sheet ejected from the ejection portion.

3. The image forming apparatus according to claim 1, wherein the first recessed portion and the second recessed portion are located closer to one end in the width direction perpendicular to the sheet ejection direction as located closer to the stopper portion in a direction parallel to the sheet ejection direction.

4. The image forming apparatus according to claim 1, wherein the first recessed portion and the second recessed portion are recessed downward to have substantially U-like cross section in a direction parallel to the sheet ejection direction.

5. The image forming apparatus according to claim 4, further comprising an image reading unit disposed above the ejection tray, wherein the image reading unit overlaps at least one of the first recessed portion and the second recessed portion closest to the ejection portion in a plan view.

6. The image forming apparatus according to claim 5, wherein the ejection tray and the image reading unit form a space therebetween, and wherein the space is surrounded by portions of the image forming apparatus except on the downstream side in the sheet ejection direction.

7. The image forming apparatus according to claim 1, further comprising a sheet supply section configured to receive one of the first sheet and the second sheet from the downstream side in the sheet ejection direction and to supply one of the first sheet and the second sheet to the image forming unit.

8. The image forming apparatus according to claim 1, wherein each of the first recessed portion and the second recessed portion has a square opening in a plan view.

9. The image forming apparatus according to claim 1, wherein each of the first recessed portion and the second recessed portion has a circular opening in a plan view.

10. The image forming apparatus according to claim 1, wherein the first recessed portion and the second recessed portion are located on each outer side of the stopper projection area.

11. The image forming apparatus according to claim l, wherein each of the first protrusion and the second protrusion of the first recessed portion and each of the first protrusion and the second protrusion of the second recessed portion has an arc shape.

12. The image forming apparatus according to claim 1, wherein the first recessed portion and the second recessed portion are further spaced apart from each other in the width direction perpendicular to the sheet ejection direction.

13. An image forming apparatus comprising: an image forming unit configured to form an image on a first sheet and a second sheet, the first sheet having a first length, the second sheet having a second length different from the first length;

an ejection portion from which the first sheet and the second sheet having the image formed in the image forming unit are to be ejected;

an ejection tray including a receiving portion configured to receive on a receiving surface the first sheet and the second sheet ejected from the ejection portion, the receiving portion having a first recessed portion and a second recessed portion, which are recessed downward therefrom; and a stopper portion disposed on a downstream side of the ejection tray in a sheet ejection direction further than the ejection portion, the stopper portion being configured to stop the first sheet and the second sheet ejected from the ejection portion, and the stopper portion defining a stopper projection area extending from the stopper portion to the ejection portion along the sheet ejection direction, wherein the first recessed portion and the second recessed portion are located downstream from the ejection portion and upstream from the stopper portion in the sheet ejection direction, wherein the first recessed portion and the second recessed portion are spaced apart from each other at least in the sheet ejection direction by at least a portion of the receiving surface, wherein the first recessed portion is spaced apart from the stopper projection area, wherein the first recessed portion is located such that a recess of the first recess portion is positioned from the ejection portion by a distance corresponding to the first length, wherein the second recessed portion is located such that a recess of the second recess portion is positioned from the ejection portion by a distance corresponding to the second length, wherein each of the first recessed portion includes a first end and a second end spaced from each other in a width direction perpendicular to the sheet ejection direction and includes a first protrusion and a second protrusion such that the first protrusion of the first recessed portion is disposed at the first end of the first recessed portion and the second protrusion of the first recessed portion is disposed at the second end of the first recessed portion, and wherein the second recessed portion includes a first end and a second end spaced from each other in the width direction and includes a first protrusion and a second protrusion such that the first protrusion of the second recessed portion is disposed at the first end of the second recessed portion and the second protrusion of the second recessed portion is disposed at the second end of the second recessed portion.

14. The image forming apparatus according to claim 13, wherein the receiving portion is configured to support downstream end-side corners of the first sheet and the second sheet ejected from the ejection portion.

15. The image forming apparatus according to claim 13, wherein the first recessed portion and the second recessed portion are located closer to one end in the width direction perpendicular to the sheet ejection direction as located closer to the stopper portion in a direction parallel to the sheet ejection direction.

16. The image forming apparatus according to claim 13, wherein the first recessed portion and the second recessed portion are located on each outer side of the stopper projection area.

17. The image forming apparatus according to claim 13, wherein the first recessed portion and the second recessed portion are further spaced apart from each other in the width direction perpendicular to the sheet ejection direction.

* * * * *